US012276172B2

(12) United States Patent
Iglesias et al.

(10) Patent No.: US 12,276,172 B2
(45) Date of Patent: Apr. 15, 2025

(54) GAS INJECTION OPERATIONAL SAFETY FOR SUBTERRANEAN WELLS

(71) Applicant: WEATHERFORD TECHNOLOGY HOLDINGS, LLC, Houston, TX (US)

(72) Inventors: Danilo Iglesias, Macaé (BR); Virgilio M. Porto, Macaé (BR)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 18/161,295

(22) Filed: Jan. 30, 2023

(65) Prior Publication Data

US 2024/0254853 A1 Aug. 1, 2024

(51) Int. Cl.
*E21B 33/068* (2006.01)
*E21B 34/02* (2006.01)
*E21B 43/12* (2006.01)

(52) U.S. Cl.
CPC ..... *E21B 33/068* (2013.01); *E21B 34/02* (2013.01); *E21B 43/122* (2013.01); *E21B 2200/05* (2020.05)

(58) Field of Classification Search
None
See application file for complete search history.

(56) References Cited

U.S. PATENT DOCUMENTS 3,860,066 A * 1/1975 Pearce ..... E21B 34/101 166/72
4,495,998 A * 1/1985 Pringle ..... E21B 34/10 166/321
4,977,957 A * 12/1990 Pringle ..... E21B 34/10 166/321
4,995,998 A * 2/1991 von Rybinski ..... B03D 1/012 252/61
7,363,908 B2 * 4/2008 Chida ..... F02D 9/107 73/756

(Continued)

OTHER PUBLICATIONS

Petroleum Technology Company; "MSAS Master Surface Annulus Safety Valve", company webpage via https://www.ptc.no, dated prior to Jan. 1, 2023 , 2 pages.

(Continued)

*Primary Examiner* — Matthew R Buck
*Assistant Examiner* — Douglas S Wood
(74) *Attorney, Agent, or Firm* — Smith IP Services, P.C.

(57) ABSTRACT

A method of injecting gas into a well can include flowing the gas through a gas flow passage extending through a housing connected to a wellhead installation, the gas thereby flowing through the wellhead installation and into an annulus in the well, and maintaining fluid pressure applied to a piston of a gas injection valve while the gas flows into the annulus. A gas injection system can include a housing having a gas flow passage extending longitudinally through the housing, and being configured to connect to a wellhead installation, and a gas injection valve including a pivotably mounted flapper closure member. The flapper closure member in an open position permits gas flow between the gas flow passage and the wellhead installation, and the flapper closure member in a closed position prevents the gas flow from the wellhead installation through the gas flow passage.

18 Claims, 5 Drawing Sheets

(56) References Cited

U.S. PATENT DOCUMENTS

| | | | | |
|---|---|---|---|---|
| 7,363,980 | B2 * | 4/2008 | Pringle | E21B 34/08 166/332.8 |
| 8,151,889 | B2 * | 4/2012 | Biddick | E21B 34/14 166/332.8 |
| 11,414,956 | B1 | 8/2022 | Burris et al. | |
| 11,454,086 | B2 | 9/2022 | Harestad | |
| 11,976,534 | B2 * | 5/2024 | Guidry | E21B 34/02 |
| 2005/0061519 | A1 * | 3/2005 | Wagner | E21B 34/101 166/332.8 |
| 2007/0158082 | A1 * | 7/2007 | Williamson | E21B 34/10 166/332.8 |
| 2010/0139923 | A1 * | 6/2010 | Biddick | E21B 34/10 166/332.8 |
| 2016/0123115 | A1 * | 5/2016 | Scott | E21B 34/066 166/332.8 |
| 2017/0292347 | A1 * | 10/2017 | Mailand | E21B 34/14 |
| 2017/0356272 | A1 | 12/2017 | Pinard et al. | |
| 2018/0010420 | A1 * | 1/2018 | Shirley | F16K 15/063 |
| 2023/0116558 | A1 * | 4/2023 | AlSultan | E21B 47/07 166/250.01 |

OTHER PUBLICATIONS

International Search Report with Written Opinion issued Mar. 26, 2024 for PCT Patent Application No. PCT/IB2023/063285, 13 pages.

* cited by examiner

GAS INJECTION OPERATIONAL SAFETY FOR SUBTERRANEAN WELLS

BACKGROUND

This disclosure relates generally to equipment utilized and operations performed in conjunction with a subterranean well and, in an example described below, more particularly provides for enhanced safety in gas injection operations.

Gas injection is used to reduce a density of a produced well fluid, so that the well fluid will more readily flow to the earth's surface. Gas is injected at relatively high pressure into an annular space surrounding a production tubing string. The gas eventually enters the tubing string via, for example, a well tool known as a gas injection mandrel. The gas mixes with the well fluid in the tubing string and thereby reduces the density of the well fluid.

It will, therefore, be readily appreciated that improvements are continually needed in the art of gas injection in wells. It is among the objects of the present specification to provide such improvements to the art. The improvements may be utilized in a wide variety of different gas injection operations and well configurations.

DETAILED DESCRIPTION

Figure 1:
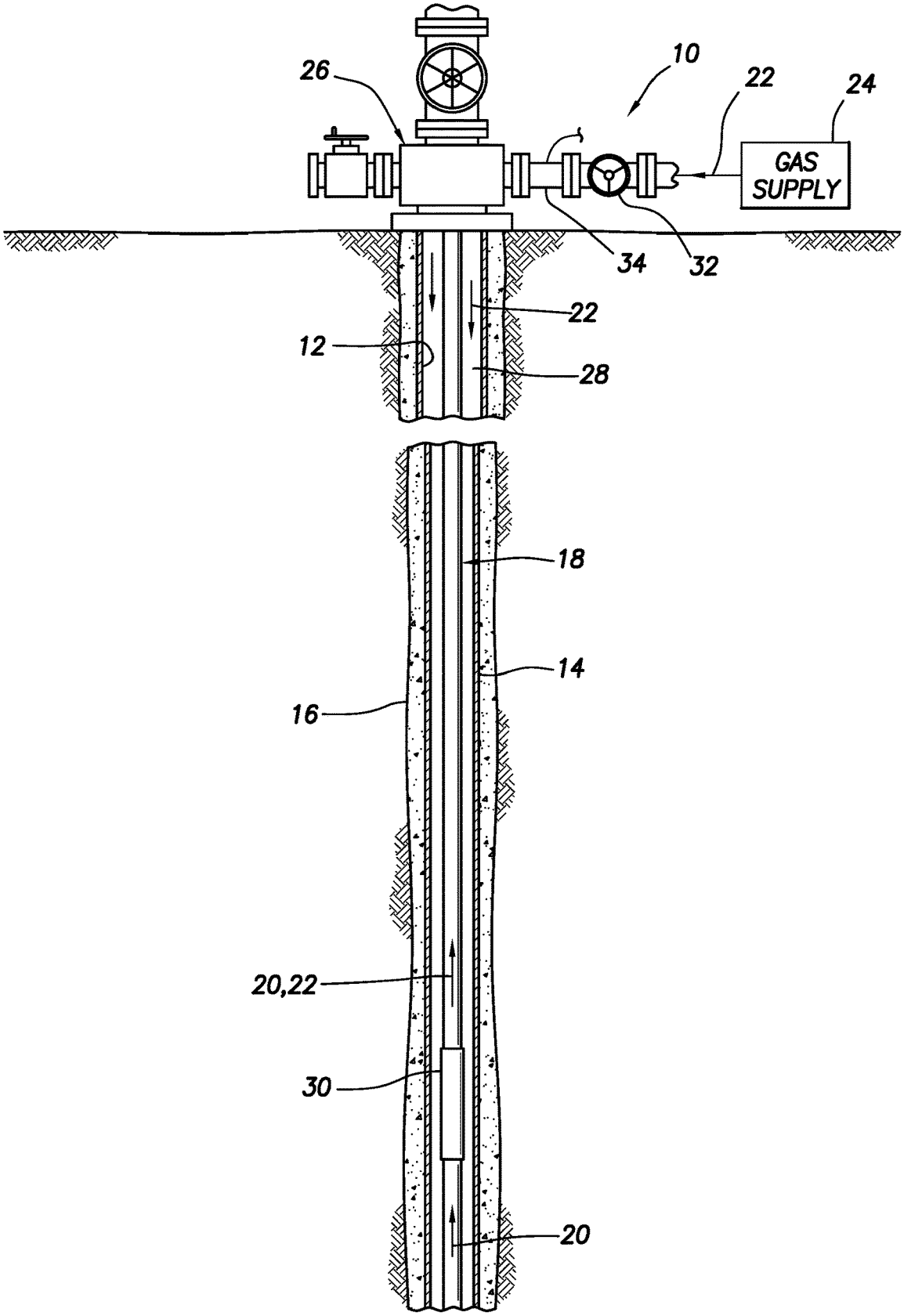
FIG. 1 is a representative partially cross-sectional view of an example of a well system and associated method which can embody principles of this disclosure.

Representatively illustrated in FIG. 1 is a gas injection system 10 for use with a subterranean well, and an associated method, which can embody principles of this disclosure. However, it should be clearly understood that the system 10 and method are merely one example of an application of the principles of this disclosure in practice, and a wide variety of other examples are possible. Although a land-based well is depicted in FIG. 1, the system 10 and method may be used with a water-based well in other examples. Therefore, the scope of this disclosure is not limited at all to the details of the system 10 and method described herein and/or depicted in the drawings.

In the FIG. 1 system 10, a wellbore 12 is lined with casing 14 and cement 16. A production tubing string 18 is positioned in the casing 14, and is used to produce well fluid 20 (such as, oil, water, gas condensates, combinations of fluids, etc.) from the well.

Gas 22 supplied from a surface gas source 24 is injected via a wellhead installation 26 (including, for example, a wellhead and Christmas tree) into an annulus 28 formed between the casing 14 and the tubing string 18. The gas 22 flows downhole through the annulus 28 to a gas injection mandrel 30 connected in the tubing string 18.

The gas 22 flows into the tubing string 18 via the gas injection mandrel 30 and mixes with the well fluid 20. The combined well fluid 20 and gas 22 flow uphole through the tubing string 18 to the surface.

A control valve 32 controls the flow of the gas 22 to the wellhead installation 26 at the surface. When the control valve 32 is opened, the gas 22 can flow from the gas source 24 to the wellhead installation 26. When the control valve 32 is closed, the gas 22 cannot flow between the gas source 24 and the wellhead installation 26.

It is desirable to have a second means of preventing flow of the gas 22 out of the wellhead installation 26. For example, in the event of an emergency (such as, a break or leak in the line between the gas source 24 and the control valve 32, or a malfunction of the control valve, etc.), it would be beneficial to have another means (other than, or in addition to, the control valve) to prevent the flow of the gas 22 from the annulus 28 via the wellhead installation 26.

In the FIG. 1 system 10, a gas injection safety apparatus 34 is connected between the control valve 32 and the wellhead installation 26. The gas injection safety apparatus 34 operates as a secondary or redundant barrier to flow of the gas 22 out of the wellhead installation 26, as described more fully below.

Figure 2:
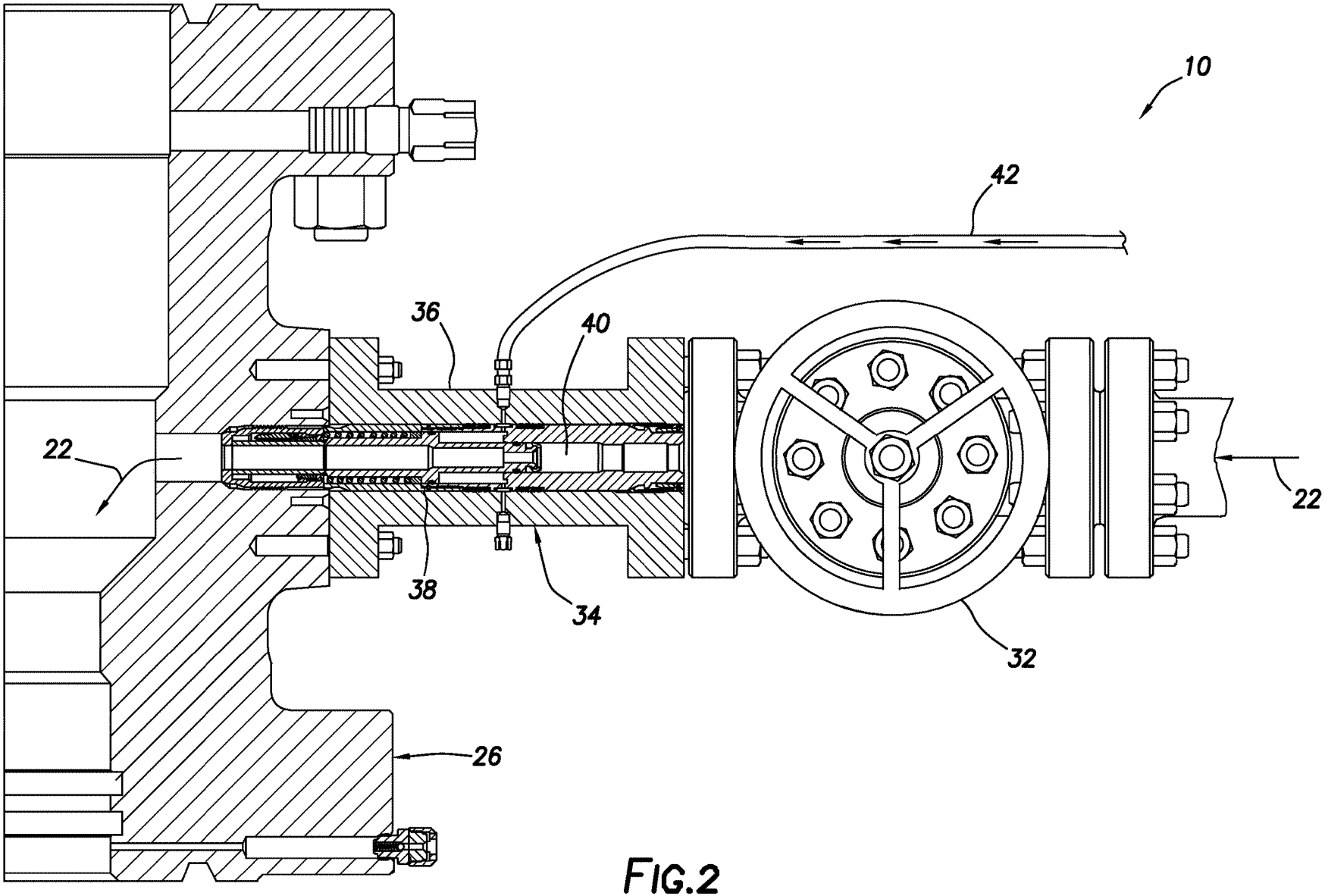
FIG. 2 is a representative partially cross-sectional view of an example of a gas injection system that may be used with the FIG. 1 system and method.

Referring additionally now to FIG. 2, a partially cross-sectional view of an example of the gas injection system 10 as used with the FIG. 1 wellhead installation 26 is representatively illustrated. However, it should be clearly understood that the scope of this disclosure is not limited to use of the gas injection system 10 with the FIG. 1 well configuration or any particular wellhead installation.

In the FIG. 2 example, the apparatus 34 includes a specially configured flanged spool 36 and a gas injection valve 38. The spool 36 is connected between the control valve 32 and the wellhead installation 26.

In this example, the gas injection valve 38 is of the type known to those skilled in the art as a flapper valve. In other examples, the gas injection valve 38 could comprise a ball valve, a sliding sleeve valve, a gate valve, or other means of selectively permitting and preventing gas 22 flow between a gas flow passage 40 and the wellhead installation 26.

The gas injection valve 38 in an open configuration (as depicted in FIG. 2) permits the flow of the gas 22 through the gas flow passage 40 into the wellhead installation 26. In a closed configuration of the gas injection valve 38 (see FIG. 5), flow of the gas 22 from the wellhead installation 26 (and the downhole annulus 28) via the gas flow passage 40 is prevented.

A pressure supply line 42 is connected to the spool 36. Fluid pressure delivered via the pressure supply line 42 is used to control operation of the gas injection valve 38 between its open and closed configurations. Specifically, the gas injection valve 38 is opened when the fluid pressure delivered via the pressure supply line 42 is greater than a predetermined level, and the gas injection valve is closed when the fluid pressure is less than the predetermined level.

Although the gas injection safety apparatus 34 is depicted in FIG. 2 as being connected between the control valve 32 and the wellhead installation 26, in other examples, the control valve could be connected between the gas injection safety apparatus and the wellhead installation. Thus, it should be appreciated that the scope of this disclosure is not limited to any particular configuration of the elements of the gas injection system 10, or to any particular configuration of the gas injection safety apparatus 34.

Figure 3:
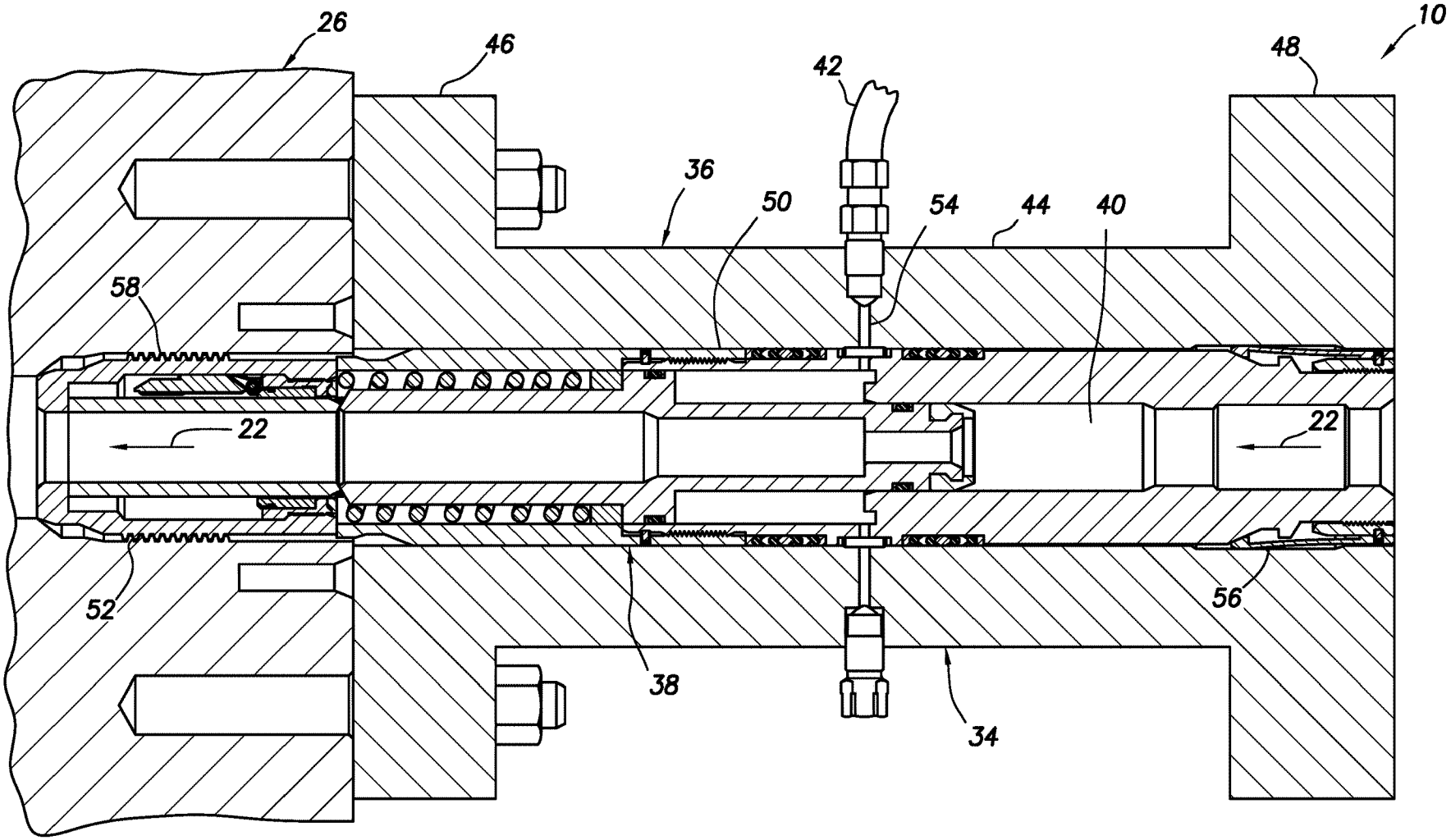
FIG. 3 is a representative cross-sectional view of an example of a gas injection safety apparatus of the gas injection system.

Referring additionally now to FIG. 3, a cross-sectional view of the gas injection safety apparatus 34 as connected to the wellhead installation 26 is representatively illustrated. The gas injection valve 38 is in its open configuration as depicted in FIG. 3, permitting the flow of the gas 22 via the gas flow passage 40 to the wellhead installation 26.

The flanged spool 36 in this example includes a generally tubular housing 44 arranged between two flanges 46, 48 at opposite ends of the spool. The gas flow passage 40 extends longitudinally through the housing 44 and flanges 46, 48.

The gas injection valve 38 includes an actuator 50 and a closure assembly 52. The actuator 50 is used to operate the closure assembly 52 between open and closed configurations. The closure assembly 52 is in its open configuration as depicted in FIG. 3.

The actuator 50 is responsive to the fluid pressure delivered via the pressure supply line 42. A port 54 is formed radially through the housing 44 to communicate the fluid pressure between the pressure supply line 42 and the actuator 50.

A retainer assembly 56 at an outer end of the gas injection valve 38 is used to secure the gas injection valve in the spool 36. The gas injection valve 38 may be installed and secured in the spool 36 before or after the spool is connected to the wellhead installation 26.

The closure assembly 52 is secured in the wellhead installation 26 by threads 58. The closure assembly 52 may be installed and secured in the wellhead installation 26 before or after the spool 36 is connected to the wellhead installation.

Figure 4:
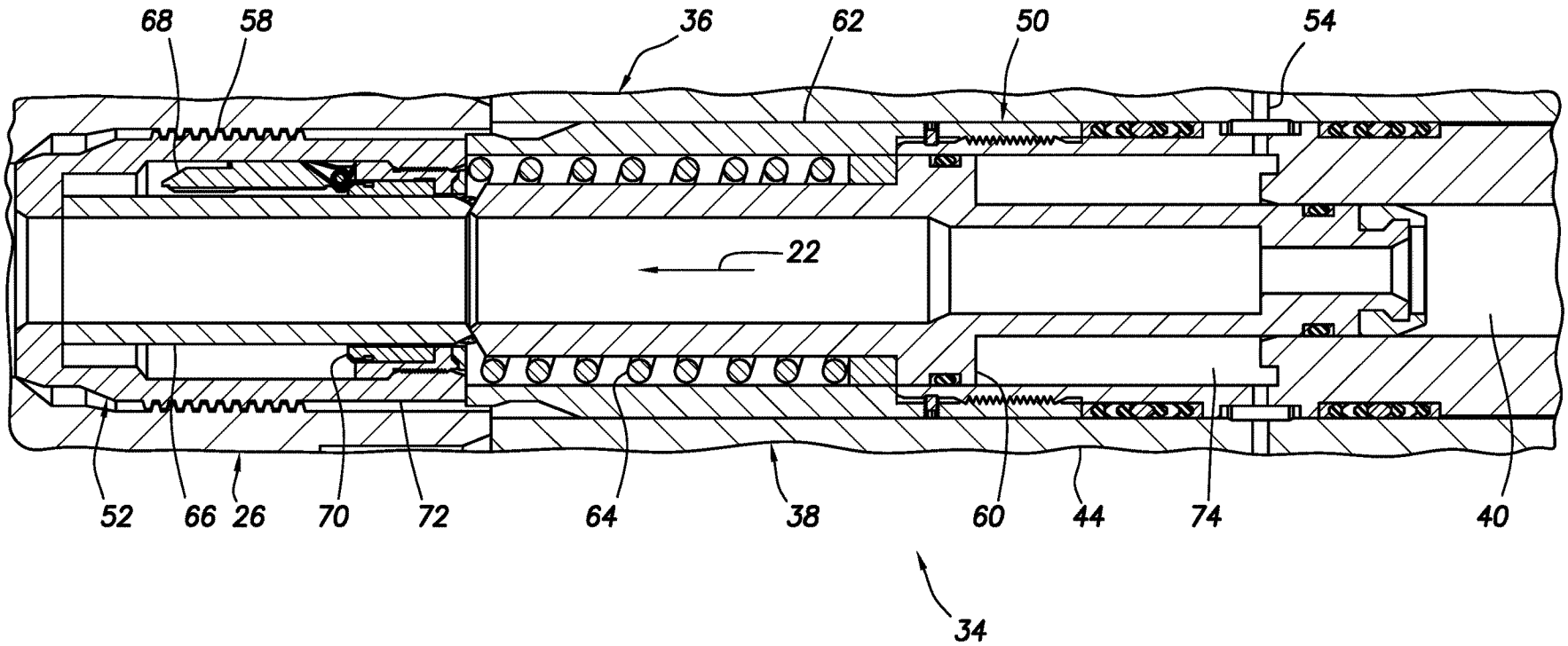
FIG. 4 is a representative cross-sectional view of a gas injection valve of the apparatus in an open configuration.

Referring additionally now to FIG. 4, a cross-sectional view of the gas injection valve 38 is representatively illustrated. The gas injection valve 38 is in its open configuration as depicted in FIG. 4.

In the FIG. 4 example, the actuator 50 includes an annular piston 60 slidingly and sealingly received in an outer housing assembly 62. A biasing device 64 (such as, a compression spring, an elastomeric material, a compressed gas, etc.) applies a biasing force that tends to displace the piston 60 to the right as viewed in FIG. 4.

A tubular prong 66 is connected at one end of the piston 60. In other examples, the prong 66 and the piston 60 could be connected by being integrally formed as a single element.

As depicted in FIG. 4, a sufficient fluid pressure is applied to an annular chamber 74 of the actuator 50 via the pressure supply line 42 (see FIG. 2) and the port 54 to overcome the biasing force exerted by the biasing device 64, as well as any gas pressure in the flow passage 40, so that the piston 60 is displaced to the left (as viewed in FIG. 4). When the piston 60 and the prong 66 displace leftward, the prong contacts and pivotably displaces a flapper closure member 68 of the closure assembly 52.

In FIG. 4, the flapper closure member 68 is pivoted upward, away from an annular seat 70 secured in a tubular housing 72 of the closure assembly 52, to an open position. In other examples, a closure member of the closure assembly 52 may displace in other directions to its open position. With the flapper closure member 68 in its open position, the gas 22 can flow through the flow passage 40 to the wellhead installation 26 from the gas source 24 (see FIG. 1).

Figure 5:
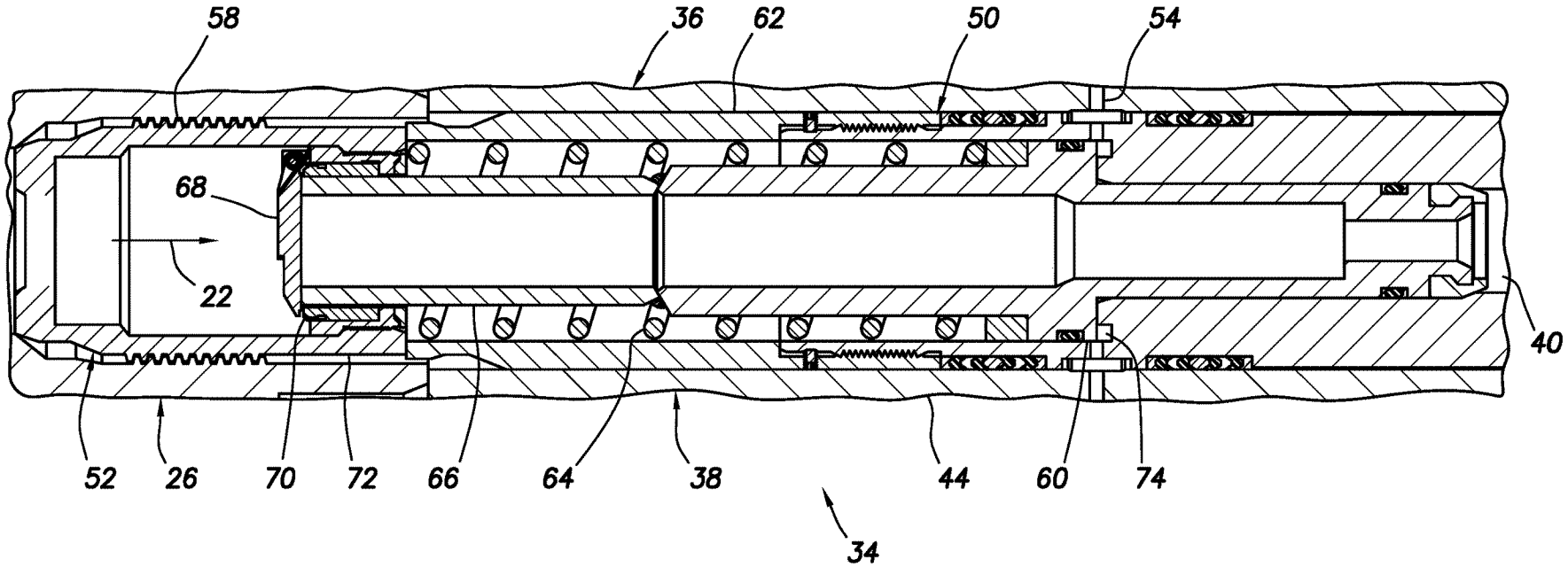
FIG. 5 is a representative cross-sectional view of the gas injection valve in a closed configuration.

Referring additionally now to FIG. 5, another cross-sectional view of the gas injection valve 38 is representatively illustrated. The gas injection valve 38 is in its closed configuration as depicted in FIG. 5.

The fluid pressure is released from the chamber 74 via the port 54, so that the biasing device 64 has displaced the piston 60 and prong 66 to the right (as viewed in FIG. 5). The rightward displacement of the prong 66 allows the flapper closure member 68 to pivot downward into sealing engagement with the seat 70. In this closed position of the flapper closure member 68, the gas 22 is prevented from flowing from the wellhead installation 26 via the flow passage 40.

Thus, when it is desired for the gas injection safety apparatus 34 to provide a barrier to escape of the gas 22 from the wellhead installation 26, the fluid pressure previously applied to the chamber 74 and piston 60 via the port 54 is released. The decrease in the fluid pressure causes the piston 60 and prong 66 to displace to the right (as viewed in FIG. 5), so that the flapper closure member 68 can pivot to its closed position.

It may now be fully appreciated that the above disclosure provides significant advancements to the art of gas injection in wells. In an example described above, a barrier to escape of gas 22 from an annulus 28 via a wellhead installation 26 can be conveniently provided by merely releasing fluid pressure previously externally applied to an actuator 50 of a gas injection safety apparatus 34.

The above disclosure provides to the art a gas injection system 10 for use with a subterranean well. In one example, the gas injection system 10 can comprise: a housing 44 having a gas flow passage 40 extending longitudinally through the housing 44, and the housing 44 being configured to connect to a wellhead installation 26 of the subterranean well; and a gas injection valve 38 disposed at least partially in the housing 44. The gas flow passage 40 extends through the gas injection valve 38. The gas injection valve 38 is configured to permit gas 22 flow into the wellhead installation 26 while a fluid pressure is applied to a piston 60 of the gas injection valve 38, and is configured to prevent the gas 22 flow from the wellhead installation 26 when the fluid pressure is released.

The housing 44 may include a port 54 configured to communicate the fluid pressure between an exterior of the housing 44 and the piston 60. The housing 44 may be connected between a surface gas source 24 and the wellhead installation 26.

The gas injection valve 38 may include a pivotably mounted flapper closure member 68. The flapper closure member 68 in an open position permits the gas 22 flow between the gas flow passage 40 and the wellhead installation 26, and the flapper closure member 68 in a closed position prevents the gas 22 flow from the wellhead installation 26 through the gas flow passage 40.

The flapper closure member 68 in the closed position may prevent the gas 22 flow from an annulus 28 in the well through the gas flow passage 40. The gas injection valve 38 may be configured to displace the flapper closure member 68 from the closed position to the open position in response to the fluid pressure applied to the piston 60 of the gas injection valve 38.

The above disclosure also provides to the art a method of injecting gas 22 into a subterranean well. In one example, the method can comprise: flowing the gas 22 through a gas flow passage 40 extending through a housing 44 connected to a wellhead installation 26, the gas 22 thereby flowing through the wellhead installation 26 and into an annulus 28 in the well; and maintaining fluid pressure applied to a piston 60 of a gas injection valve 38 disposed at least partially in the housing 44 so that the gas flow passage 40 extends through the gas injection valve 38, the fluid pressure being maintained while the gas 22 flows into the annulus 28.

The method may include releasing the fluid pressure from the piston 60, thereby preventing the gas 22 from flowing out of the wellhead installation 26 via the gas flow passage 40.

The method may include connecting the housing 44 between the wellhead installation 26 and a control valve 32 that selectively permits and prevents the gas 22 flow between the wellhead installation 26 and a gas source 24.

The gas injection valve 38 may include a pivotably mounted flapper closure member 68. A prong 66 connected to the piston 60 may displace the flapper closure member 68 to an open position when the fluid pressure is applied to the piston 60.

The method may include releasing the fluid pressure, thereby permitting the flapper closure member 68 to displace to a closed position. The fluid pressure maintaining step may include applying the fluid pressure via a port 54 formed through the housing 44.

A gas injection system 10 for use with a subterranean well described above can include a housing 44 having a gas flow passage 40 extending longitudinally through the housing 44, and the housing 44 being configured to connect to a wellhead installation 26 of the subterranean well, and a gas injection valve 38 disposed at least partially in the housing 44, whereby the gas flow passage 40 extends through the gas injection valve 38. The gas injection valve 38 includes a pivotably mounted flapper closure member 68. The flapper closure member 68 in an open position permits gas 22 flow between the gas flow passage 40 and the wellhead installation 26, and the flapper closure member 68 in a closed position prevents the gas 22 flow from the wellhead installation 26 through the gas flow passage 40.

The flapper closure member 68 in the closed position may prevent the gas 22 flow from an annulus 28 in the well through the gas flow passage 40. The gas injection valve 38 may be configured to displace the flapper closure member 68 from the closed position to the open position in response to fluid pressure applied to a piston 60 of the gas injection valve 38.

The housing 44 may include a port 54 configured to communicate the fluid pressure between an exterior of the housing 44 and the piston 60. The housing 44 may be connected between a surface gas source 24 and the wellhead installation 26.

The gas injection valve 38 may be configured to permit the gas 22 flow into the wellhead installation 26 while a fluid pressure is applied to a piston 60 of the gas injection valve 38, and to prevent the gas 22 flow from the wellhead installation 26 when the fluid pressure is released.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas injection system for use with a subterranean well, the gas injection system comprising:

a housing having a gas flow passage extending longitudinally through the housing, and the housing being configured to connect to a wellhead installation of the subterranean well, in which the housing is positioned upstream of the wellhead installation relative to a direction of gas injection through the wellhead installation; and a gas injection valve disposed at least partially in the housing, whereby the gas flow passage extends through the gas injection valve, in which the gas injection valve includes a pivotably mounted flapper closure member, and in which the gas injection valve is configured to permit gas flow into the wellhead installation while a fluid pressure is applied to a piston of the gas injection valve, and to prevent the gas flow from the wellhead installation when the fluid pressure is released.

2. The gas injection system of claim 1, in which the housing includes a port configured to communicate the fluid pressure between an exterior of the housing and the piston.

3. The gas injection system of claim 1, in which the housing is connected between a surface gas source and the wellhead installation.

4. The gas injection system of claim 1, in which the flapper closure member in an open position permits the gas flow between the gas flow passage and the wellhead installation, and the flapper closure member in a closed position prevents the gas flow from the wellhead installation through the gas flow passage.

5. The gas injection system of claim 4, in which the flapper closure member in the closed position prevents the gas flow from an annulus in the well through the gas flow passage.

6. The gas injection system of claim 4, in which the gas injection valve is configured to displace the flapper closure member from the closed position to the open position in response to the fluid pressure applied to the piston of the gas injection valve.

7. A method of injecting gas into a subterranean well, the method comprising:

flowing the gas through a gas flow passage extending through a housing connected to a wellhead installation, the gas thereby flowing through the wellhead installation and into an annulus in the well, in which the housing is positioned upstream of the wellhead installation relative to a direction of gas injection through the wellhead installation; and maintaining fluid pressure applied to a piston of a gas injection valve disposed at least partially in the housing so that the gas flow passage extends through the gas injection valve, the fluid pressure being maintained while the gas flows into the annulus, in which the gas injection valve includes a pivotably mounted flapper closure member.

8. The method of claim 7, further comprising releasing the fluid pressure from the piston, thereby preventing the gas from flowing out of the wellhead installation via the gas flow passage.

9. The method of claim 7, further comprising connecting the housing between the wellhead installation and a control valve that selectively permits and prevents the gas flow between the wellhead installation and a gas source.

10. The method of claim 7, in which the piston displaces the flapper closure member to an open position when the fluid pressure is applied to the piston.

11. The method of claim 10, further comprising releasing the fluid pressure, thereby permitting the flapper closure member to displace to a closed position.

12. The method of claim 7, in which the maintaining comprises applying the fluid pressure via a port formed through the housing.

13. A gas injection system for use with a subterranean well, the gas injection system comprising:

a housing having a gas flow passage extending longitudinally through the housing, and the housing being configured to connect to a wellhead installation of the subterranean well, in which the housing is positioned upstream of the wellhead installation relative to a direction of gas injection through the wellhead installation; and a gas injection valve disposed at least partially in the housing, whereby the gas flow passage extends through the gas injection valve, and the gas injection valve includes a pivotably mounted flapper closure member, in which the flapper closure member in an open position permits gas flow between the gas flow passage and the wellhead installation, and the flapper closure member in a closed position prevents the gas flow from the wellhead installation through the gas flow passage.

14. The gas injection system of claim 13, in which the flapper closure member in the closed position prevents the gas flow from an annulus in the well through the gas flow passage.

15. The gas injection system of claim 13, in which the gas injection valve is configured to displace the flapper closure member from the closed position to the open position in response to fluid pressure applied to a piston of the gas injection valve.

16. The gas injection system of claim 15, in which the housing includes a port configured to communicate the fluid pressure between an exterior of the housing and the piston.

17. The gas injection system of claim 13, in which the housing is connected between a surface gas source and the wellhead installation.

18. The gas injection system of claim 13, in which the gas injection valve is configured to permit the gas flow into the wellhead installation while a fluid pressure is applied to a piston of the gas injection valve, and to prevent the gas flow from the wellhead installation when the fluid pressure is released.

* * * * *